US005617508A

United States Patent [19]

Reaves

[11] Patent Number: 5,617,508

[45] Date of Patent: Apr. 1, 1997

[54] SPEECH DETECTION DEVICE FOR THE DETECTION OF SPEECH END POINTS BASED ON VARIANCE OF FREQUENCY BAND LIMITED ENERGY

[75] Inventor: Benjamin K. Reaves, Yamatotakada, Japan

[73] Assignees: Panasonic Technologies Inc., Secausus, N.J.; Matsushita Electric Industrial Co., Ltd., Osaka, Japan

[21] Appl. No.: 105,755

[22] Filed: Aug. 12, 1993

Related U.S. Application Data

[63] Continuation-in-part of Ser. No. 956,614, Oct. 5, 1992.

[51] Int. Cl.[6] ..... G10L 9/00

[52] U.S. Cl. ..... 395/2.42; 395/2.57; 395/2.62; 395/2.23; 395/2.35

[58] Field of Search ..... 381/46, 43, 94; 395/2.42, 2, 2.23, 2.35

[56] References Cited

U.S. PATENT DOCUMENTS

| | | | |
|---|---|---|---|
| Re. 32,172 | 6/1986 | Johnston et al. | 381/46 |
| 4,032,711 | 6/1977 | Sambur | 381/46 |
| 4,401,849 | 8/1983 | Ichikawa et al. | 381/46 |
| 4,410,763 | 10/1983 | Strawczynski et al. | 364/513.5 |
| 4,433,435 | 2/1984 | David | 381/94 |
| 4,531,228 | 7/1985 | Noso et al. | 381/46 |
| 4,552,996 | 11/1985 | De Bergh | 381/46 |
| 4,627,091 | 12/1986 | Fedele | 381/46 |
| 4,696,041 | 9/1987 | Sakata | 381/46 |
| 4,718,097 | 1/1988 | Uenoyama | 381/46 |
| 4,815,136 | 3/1989 | Benvenuto . | |
| 5,151,940 | 9/1992 | Okazaki et al. | 381/43 |
| 5,222,147 | 6/1993 | Koyama . | |
| 5,305,422 | 4/1994 | Junqua | 395/2.62 |
| 5,323,337 | 6/1994 | Wilson et al. | 381/46 |

OTHER PUBLICATIONS

"A Robust Speech/Non–Speech Detection Algorithm Using Time and Frequency–Based Features," by Brian Mak et al., 1992, IEEE, pp. I–269–I–272.

*Primary Examiner*—Allen R. MacDonald
*Assistant Examiner*—Vijay B. Chawan
*Attorney, Agent, or Firm*—Price, Gess & Ubell

[57] ABSTRACT

The device detects the beginning and ending portions of speech contained within an input signal based on the variance of frequency band limited energy within the signal. The use of the variance allows detection which is relatively independent of an absolute signal-to-noise ratio with the signal, and allows accurate detection within a wide variety of backgrounds such as music, motor noise, and background noise, such as other speakers. The device can be easily implemented using off-the-shelf hardware along with a high-speed special purpose digital signal processor integrated circuit.

7 Claims, 6 Drawing Sheets

103
202
nf
203
HAMMING WINDOW
FOURIER TRANSFORM
dB
SUM
204
205
206
207
208
209
nv
VARIANCE CALCULATOR
210
211
105

SPEECH DETECTION DEVICE FOR THE DETECTION OF SPEECH END POINTS BASED ON VARIANCE OF FREQUENCY BAND LIMITED ENERGY

CROSS-REFERENCE TO RELATED APPLICATION

This application is a continuation-in-part of copending application Ser. No. 07/956,614 filed Oct. 5, 1992 for SPEECH DETECTION DEVICE.

BACKGROUND OF THE INVENTION

1. Field of the Invention

The invention generally relates to a device for the detection of the start and end of a segment containing speech within an input audio signal which contains both speech segments and nonspeech noise or background segments.

2. Description of Related Art

Detection of speech in real time is a necessary component for many devices, including but not limited to voice-activated tape recorders, answering machines, automatic speech recognizers, and processors for removing speech from music. Many of these applications have noise inseparably mixed with the speech. Detection of speech requires a more sophisticated speech detection capability than provided by conventional devices that simply detect when energy level rises above or falls below a preset threshold.

In the field of automatic speech recognition, the speech detection component is most critical. In practice, more speech recognition errors arise from errors in speech detection than from errors in pattern matching, which is commonly used to determine the content of the speech signal. One proposed solution is to use a word spotting technique, in which the recognizer is always listening for a particular word. However, if word spotting is not preceded by speech detection, the overall error rate can be high.

Many speech detection devices are based on a certain parameter of the input, such as energy, pitch, and zero crossings. The performance of the speech detector depends heavily on the robustness of that parameter to background noise. For real time speech detection, the parameters must be quickly extracted from the signal.

SUMMARY OF THE INVENTION

One of the objects of the present invention is to provide a device for the detection of speech which is capable of operation at a speed fast enough to keep up with the arrival of the input, i.e., real time.

Another object of the present invention is to provide a device for the detection of speech that can be implemented with a conventional digital signal processing circuit board.

Another object of the present invention is to provide a device for the detection of speech which is effective despite various types of noise mixed with the speech.

Another object of the present invention is to provide a speech detection device for various applications, including, but not limited to: isolated word automatic speech recognizers, continuous speech recognizers (to detect pauses between phrases or sentences), voice-controlled tape recorders, answering machines, and the processing of voice embedded in a recording with background noise or music.

These and other objects of the invention are achieved by the provision of a device for detecting speech in an input signal which includes means for determining a value representative of frequency band limited energy within the signal, means for determining a variance of the value representative of the frequency band limited energy of the signal, and means for determining the beginning and ending points of speech within the signal based on the variance of the band limited energy.

The invention exploits the variance in the frequency band limited energy to detect the beginning and end of speech within an input speech signal. Variance of the frequency band limited energy is employed based on the observation that for foreground speech occurring in a difficult background, such as a lead vocalist against a background of music, there is a noticeable fluctuation of the energy level above a "noise floor" of relatively low fluctuation. This effect occurs although the level of the foreground and the level of the background may be high. Variance quantifies that fluctuation of energy.

In accordance with the preferred embodiment, the device calculates frequency band limited energy using a Hamming window and a Fourier transform. The variance is calculated as a function of time from frequency band limited energy values stored in a shift register. To determine the beginning and ending points of speech within an input signal, the device compares the variance as a function of time with two predetermined threshold levels, an upper threshold level and a lower threshold level. If the variance exceeds the lower threshold level, the device tentatively determines that speech has begun. However, if the variance does not subsequently rise above the upper threshold level before falling below the lower threshold level, then the tentative determination of the beginning of speech is discarded. When the variance is between the lower and upper threshold levels, the device characterizes the signal as being in a beginning (B) speech state. Once the variance exceeds the upper threshold level, the device characterizes the signal as being within a speech (S) state. If the variance does not remain within speech state (S) for at least a predetermined period of time, such as 0.3 seconds, the speech is rejected as being too short. If the variance remains above the upper threshold level for at least the predetermined period of time, then the determination of the beginning point of the speech is retained. Finally, the ending point of the speech is determined when the variance falls below the lower threshold level.

By employing upper and lower threshold levels and by testing whether the variance remains within the speech state for at least a predetermined period of time, the error rate in detecting speech is minimized.

Preferably, the device is implemented within integrated circuit hardware such that the processing of the input signal to determine the beginning and ending points of speech based on the variance of the frequency band limited energy can be performed in real time.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like parts throughout the figures thereof, and wherein.

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a speech detection device which detects the beginning and ending points of speech based on the variance of the frequency band limited energy of an input signal.

Figure 1:
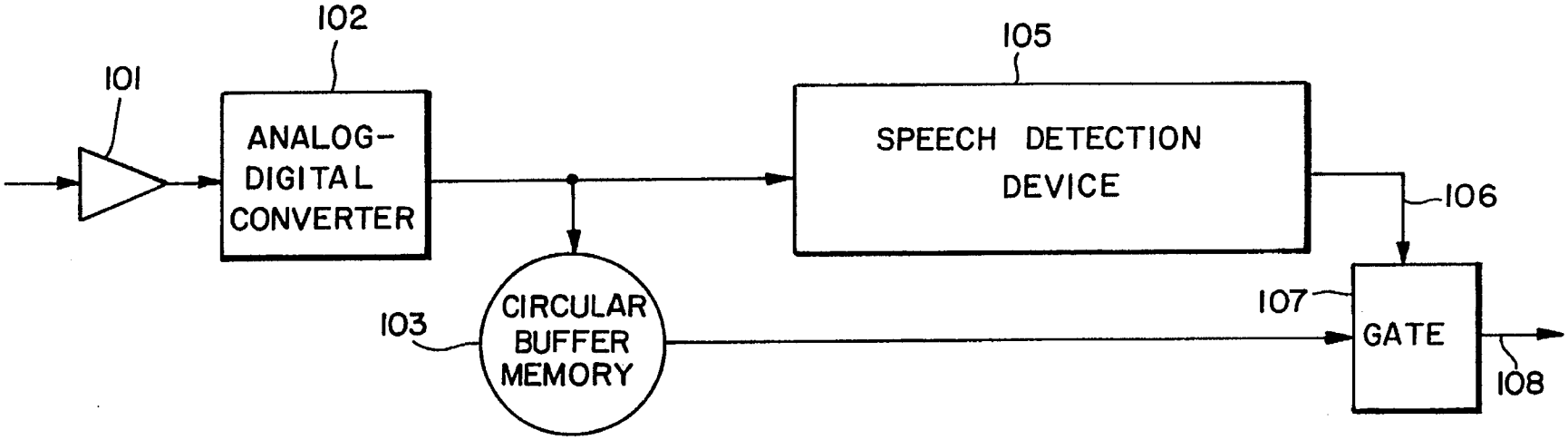
FIG. 1 provides a block diagram of an automatic speech recognizer, employing a speech detection device in accordance with a preferred embodiment of the invention.

A preprocessor for an isolated word automatic speech recognition system using the present invention is illustrated in FIG. 1. Analog input 101, from a microphone, is voltage-amplified and converted to digital from by an analog-to-digital converter 102 at a rate equal to a sampling frequency (typically 10,000 samples per second). A resulting digital signal 103 is saved in a memory area 104 that can store up to 6.5536 seconds of speech—a period longer than any single word utterance. If the capacity of 104 is exceeded, then old data are erased as new data are saved. Thus, 104 contains the most recent 6.5536 seconds of input data. The digital signal 103 also serves as input to a speech detection device 105. An output decision signal 106 triggers a gate 107 to pass a portion of memory 104 which has been determined by 105 to contain speech, to an output 108. For different applications, the length of buffer 104 can be modified and, in some applications such as an answering machine, buffer 104 can be eliminated, and signal 106 can control a tape drive directly.

Figure 2:
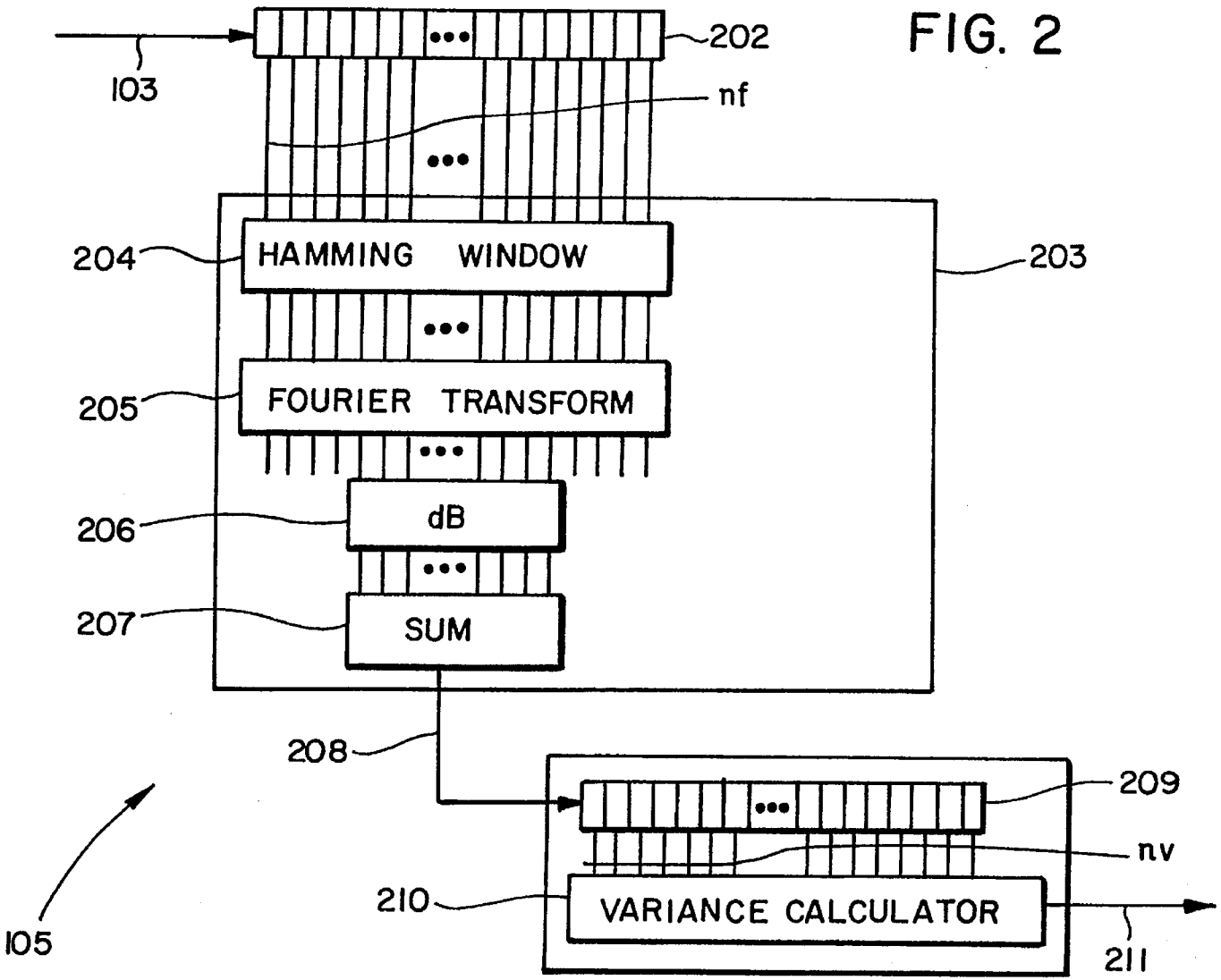
FIG. 2 is a block diagram of the speech detection device of FIG. 1.
Figure 3:
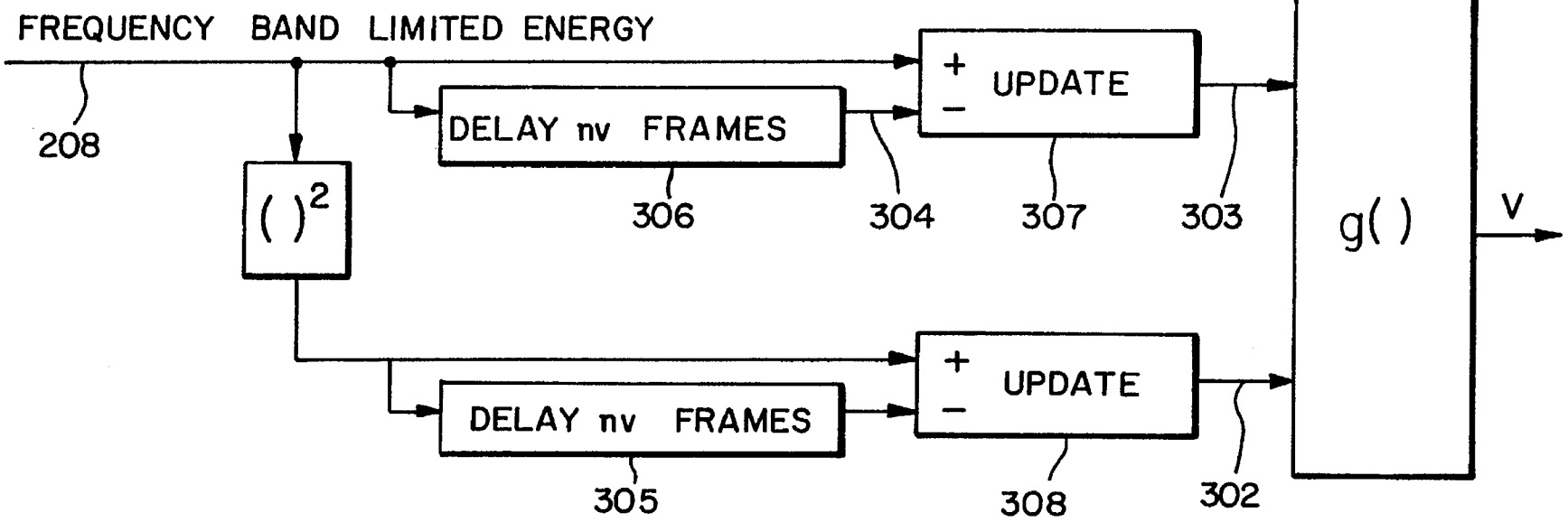
FIG. 3 provides a flow chart illustrating a method for determining the variance of the frequency band limited energy employed by the speech detection device of FIG. 1.
Figure 4:
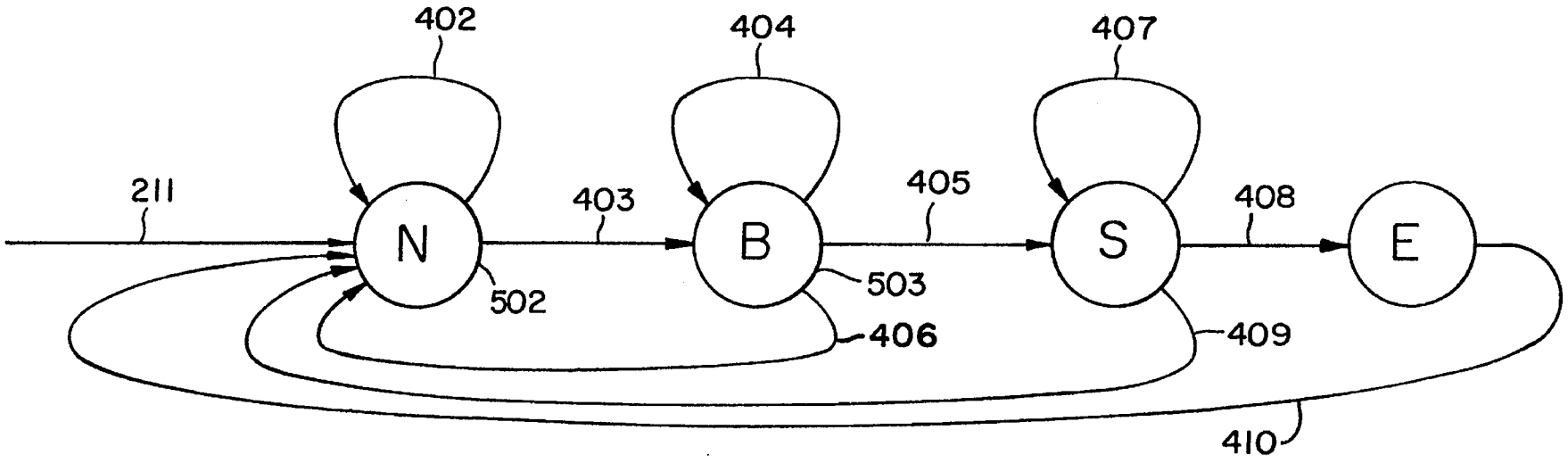
FIG. 4 is a state diagram illustrating the speech detection device of FIG. 2.

Speech detection device 105 is illustrated in detail in FIGS. 2, 3, and 4. The digital input signal 103 of FIG. 1 is shown as input signal 201 of FIG. 2. Signal 201 enters a delay line that keeps nf consecutive samples of the input (e.g. 256). When it is filled, a frequency band limiter 203 starts processing the signal. When nf/2 (e.g. 128) new samples of input data 201 have been received, a delay line 202 shifts 128 to the right, erasing the 128 oldest samples, and fills the left half with 128 new samples. Thus, shift register 202 always contains 256 consecutive samples of the input and overlaps 50% with the previous contents. The unit of time for the 128 new samples to be ready is a frame, and one frame is, e.g., 0.0128 seconds.

The frequency band limited energy is calculated in 203. After multiplying elements of the delay line by a Hamming window, a Fourier transform, 205, extracts the frequency spectrum of the contents of 202. The spectral components corresponding to frequencies between 250 Hz and 3500 Hz, the band that contains the most important speech information, are converted to units of decibels by 206, and are summed together in 207, producing the frequency band limited energy.

Alternatively, frequency band limiting may be performed by a method other than summing the portions of a frequency spectrum converter. For example, the input signal may be digitally filtered by convolution or by passing through a digital filter, which replaces 202 and all of 203 of FIG. 2. Then, the resulting energy of the signal may be measured by a method described below.

Also, band limiting may be performed in the analog domain, with the energy obtained directly from the filter, or by a method described below. The analog band limiter may consist of a band-pass filter, a low pass filter, or another spectral shaping filter, or may arise from frequency limiting inherent in an amplifier or microphone, or may take the form of an antialiasing filter. The energy may be obtained directly from the filter or by a method described in the following paragraph. The signal resulting from either of these alternative techniques is hereafter referred to as the frequency band limited signal.

Any quantity that varies generally monotonically with the energy of the frequency band limited signal is hereafter called the frequency band limited energy. Instead of the method described in FIG. 2, the frequency band limited energy may be calculated by: (a) calculating the variance of the frequency band limited signal over a short period of time; (b) summing the absolute value, magnitude, rectified value, or square or other even power of the frequency band limited signal over a short period of time; or (c) determining the peak of the value, the magnitude, the rectified value, or square or other power of the frequency band limited signal over a short period of time.

Continuing with the preferred embodiment of the invention, frequency band limited energy 208 enters a delay line 209 which differs from delay line 202 in that (a) it receives one (not 128) new entry every frame, and (b) it shifts right by one (not by 128) when each new entry arrives. The length of this delay line 209 is nv, which corresponds to a pause length of, for example, 0.64 seconds, or 50 frames:

$$nv = \frac{(\text{pauselength}) \times (\text{sampling frequency})}{(nf/2)}$$

Variance calculation unit 210 calculates the variance of the values in delay line 209. V, the variance of the frequency band limited energy, is:

$$V = g\,(A, B)$$

where $$g(A, B) = \frac{A}{nv} - \frac{(B \times B)}{(nv \times nv)}$$

and $$A = \sum_{f=1}^{f=nv} [BLE(f) \times BLE(f)]$$

and $$B = \sum_{f=1}^{f=nv} BLE(f)$$

and

V is the output 211 of the variance calculation 210;

and

BLE(f) is the contents of delay line 209 at locations f=nv, . . . , 3, 2, 1; BLE(1) is the oldest BLE value; and BLE is the frequency band limited energy;

and

Figure 5:
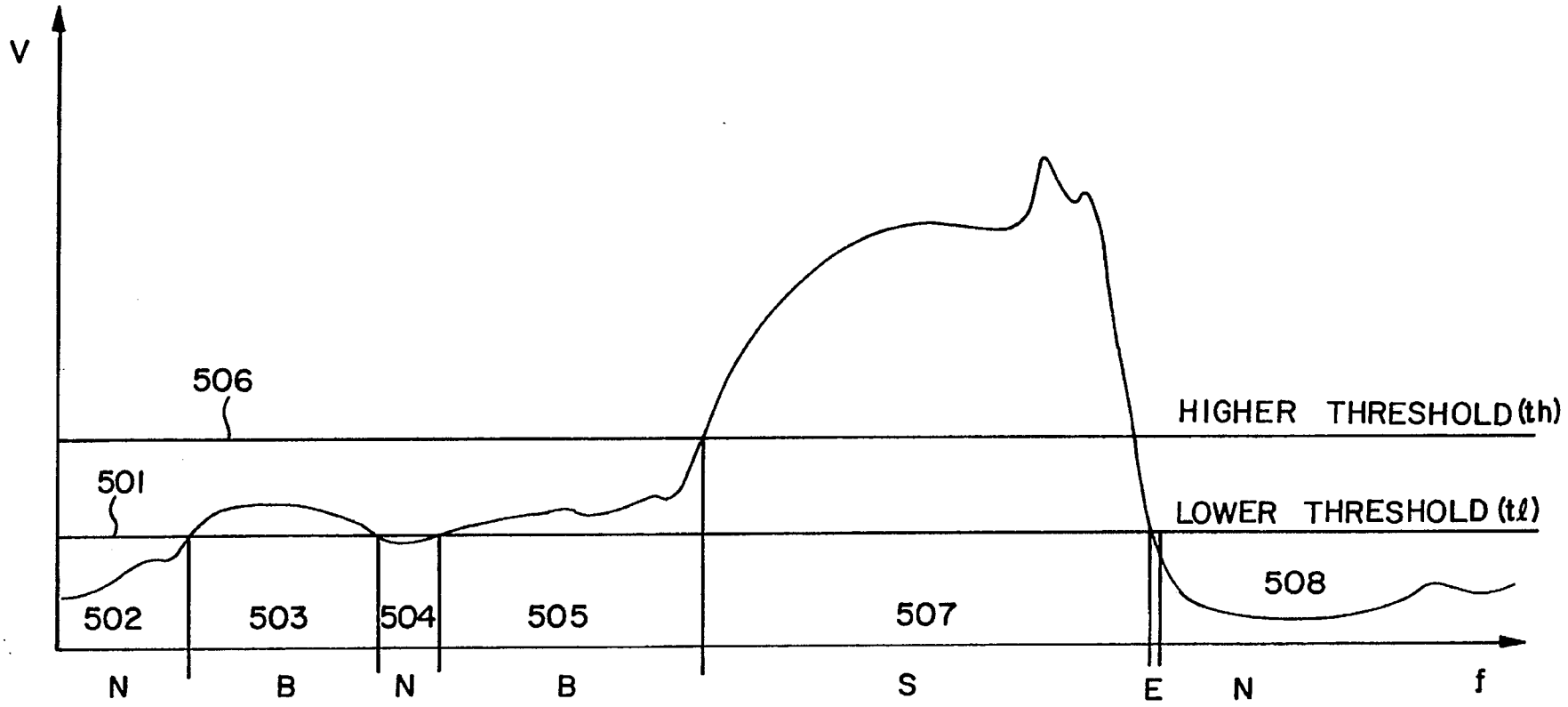
FIG. 5 is an exemplary input signal.

The variance 211 drives the decision unit 212, the operation of which is shown in FIGS. 4 and 5.

FIG. 3 shows a faster way to calculate the variance V, replacing the variance calculation 210 and delay line 209. This preferred technique updates, rather than recalculates, quantities A and B as follows:

$$A'=A+[BLE(nv)\times BLE(nv)]-[BLE(0)\times BLE(0)]B'=B+BLE(nv)-BLE(0)$$

where

A'is the updated value for A, shown as 302, and

B'is the updated value for B, shown as 303, and

BLE(nv) is the newest frequency band limited energy, 301, from 208 of FIG. 2, and BLE(0) is the oldest frequency band limited energy, 304.

The square of BLE is delayed in the delay line 305. This delay line can be removed and replaced by squaring the value from 304 in situations where memory is expensive but multiplication is inexpensive. The delay lines 305 and 306 should be cleared to zero upon initialization. Also, note that the delay lines 306 and 305 are one longer than delay line 209 of FIG. 2.

FIG. 4 shows a state diagram that describes the operation of the decision unit (212 in FIG. 2 and 612 in FIG. 6) which uses the variance (211 in FIG. 2 or 611 in FIG. 6) to detect the existence of speech. FIG. 5 shows an example of a speech signal as an aid in understanding the state diagram.

The state diagram begins in the N or Noise state (502). As long as the variance V, which is from 211 of FIG. 2, stays below the lower threshold 501, transition is taken, and state N is not exited. When V rises 402 above threshold 501, transition 403 is taken, and state B (beginning of speech) is entered. One of three transitions can be taken from state B, depending on the conditions, as follows:

th<V: transition 405 (advance to S, speech)

tl<V<th: transition 404 (stay in B)

0<V<tl: transition 406 (rejected: go to N) where th is 506 and tl is 501.

Segments 502, 503, and 504 show how these transition conditions make the device wait for a sizable rise in variance before entering the S, or speech, state. The conditions and transitions for exiting the state S are:

| | |
|---|---|
| tl < V: | transition 407 (stay in S) |
| V < tl and duration in S > 0.3 second: | transition 408 |
| V < tl and duration in S < 0.3 second: | transition 409 |

The conditions for exiting state S depend on tl, not th, to avoid instability when V is near th. Transition 409 rejects utterances that are too short to be a single word. Segment 507 shows the usual case: staying in state S until the variance decreases below tl, taking transition 408 to state E.

State E triggers the action 106 of FIG. 1, showing that the end of the utterance has been found. Because the variance depends on the past nv (FIG. 3) frames, it will decrease about nv frames after the frequency band limited energy fluctuations decrease. After state E the state recycles to state N, to be ready for the next utterance.

Thresholds tl, 501, and th, 506 are determined early in a first N state, by examining the level of the variance there. They are set as follows:

th=3.0×average of variance of 10 frames of N state;

tl=1.2×average of variance of 10 frames of N state.

What has been described is a device for detecting the presence of speech within an input signal. The device calculates the beginning the ending points of speech based on the variance of the frequency band limited energy within the signal. By utilizing the variance of the frequency band limited energy, the presence of speech is effectively detected in real time. The device is particularly useful for detecting a segment of a recording that contains speech, such that the segment can be extracted and further processed.

Figure 6:
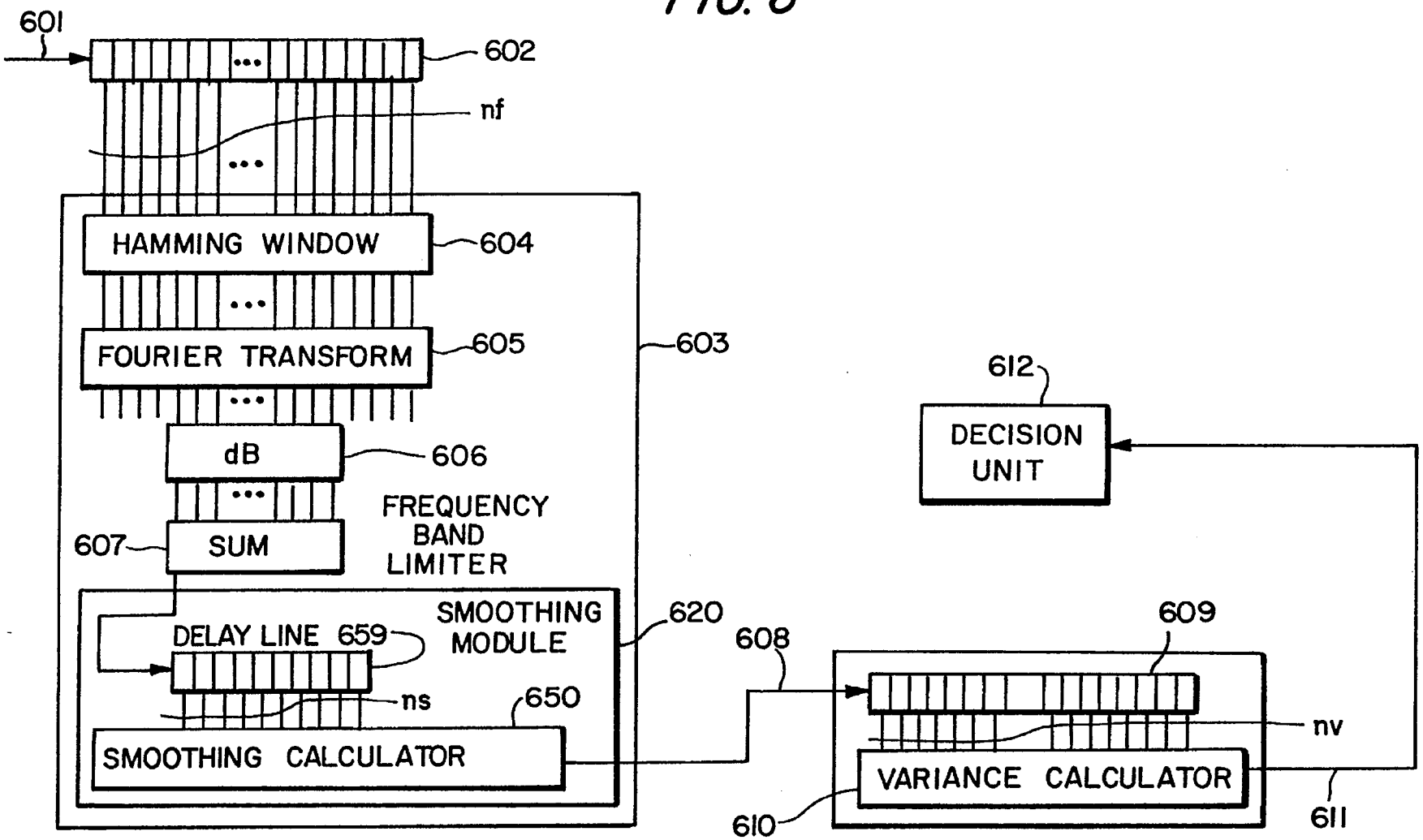
FIG. 6 is a block diagram of one speech detection device of FIG. 1 in the second embodiment, illustrating the smoothing function.

FIG. 6 illustrates the second preferred embodiment. The major difference between this embodiment and the previously-described embodiment is the inclusion of the smoothing module 620 in the frequency band limiter. In this embodiment, the output from the modified frequency band limiter 608 is the frequency band limited energy.

The output 651 from the summation of the frequency transform, which is calculated in the same way as the frequency band limited energy of the previously-described embodiment, enters a delay line 659. At every frame, in this example 12.8 milliseconds, this delay line receives a new sample and shifts the remaining sample to the right by one. Its length in this example is 10 frames, corresponding to 0.128 seconds.

Smoothing calculation unit 650 calculates the mean value of the contents of the delay line 659, and that value is the frequency band limited energy 608.

Alternatively, the smoothing calculation 650 may be performed by calculating the median of the values in the delay line 659, or by calculating any function which has the effect of smoothing, or otherwise suppressing short, impulsive variations of the contents of the delay line 659.

Because the smoothing calculation 650 has the effect of removing rapid changes in the contents of delay line 659, the delay line 609 for the variance calculation may receive new values at a rate slower than the rate at which new values are received by delay line 659.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A device for detecting speech in an input signal comprising:

first determining means for determining a plurality of values representative of a plurality of frequency band limited energy within the signal, wherein the signal is sampled at a predetermined sampling rate in a single frequency band over a first plurality of frames, wherein each frame comprises a plurality of samples;

second determining means for receiving the plurality of values from said first determining means, and determining a variance of the frequency band limited energy of the signal in the single frequency band over a second plurality of frames;

third determining means for determining beginning and ending points of speech within the signal using the variance of the frequency band limited energy; and a signal recording device including:

means for receiving the signal;

means for storing the most recent m seconds of the received signal; and means for selecting the portion of the stored signal that corresponds to the start and the end points determined by said third determining means.

2. The device of claim 1, where m is between 0.1 and 100 seconds.

3. The device of claim 1, wherein the second plurality of frames is between 0.1 and 10 seconds in duration.

4. A device for detecting speech in an input signal comprising:

first determining means for determining a plurality of values representative of a plurality of frequency band limited energy within the signal, wherein the signal is sampled at a predetermined sampling rate in a single frequency band over a first plurality of frames, wherein each frame comprises a plurality of samples, said first determining means including:

means for calculating the energy of the frequency band limited signal; and means for applying a smoothing function to energy of the frequency band limited signal to generate the frequency band limited energy;

second determining means for receiving the plurality of values from said first determining means, and determining a variance of the frequency band limited energy of the signal in the single frequency band over a second plurality of frames; and third determining means for determining beginning and ending points of speech within the signal using the variance of the frequency band limited energy.

5. The device of claim 4, wherein said means for applying a smoothing function to the energy of the frequency band limited signal comprises:

means for calculating the median of values representative of the energy of the frequency band limited signal.

6. The device of claim 4, wherein said means for applying a smoothing function to the energy of the frequency band limited signal comprises:

means for calculating the mean of values representative of the energy of the frequency band limited signal.

7. The device of claim 4, wherein said means for applying a smoothing function to the energy of the frequency band limited signal comprises:

filter means for suppressing quick variations of the energy of the frequency band limited signal.

* * * * *